United States Patent [19]

Ryason

[11] 4,206,713

[45] Jun. 10, 1980

[54] CONTINUOUS COAL PROCESSING METHOD

[75] Inventor: Porter R. Ryason, La Canada, Calif.

[73] Assignee: The United States of America as represented by the Administrator of the National Aeronautics & Space Administration, Washington, D.C.

[21] Appl. No.: 727,444

[22] Filed: Sep. 28, 1976

Related U.S. Application Data

[63] Continuation-in-part of Ser. No. 623,389, Oct. 17, 1975, abandoned.

[51] Int. Cl.[2] ..... F23B 7/00

[52] U.S. Cl. ..... 110/347; 110/218; 110/229; 110/232; 110/343; 202/118; 264/23; 425/378 R

[58] Field of Search ..... 110/110, 347, 218, 229, 110/232, 342, 343; 264/23; 425/378, 379; 202/118, 119; 201/35

[56] References Cited

U.S. PATENT DOCUMENTS

| | | | |
|---|---|---|---|
| 3,354,501 | 11/1967 | Bachman et al. | 425/378 X |
| 3,472,185 | 10/1969 | Burden | 110/216 |
| 3,523,147 | 8/1970 | Hold et al. | 264/23 |
| 3,976,548 | 8/1976 | Kevorkian et al. | 110/110 X |

*Primary Examiner*—Edward G. Favors
*Attorney, Agent, or Firm*—Monte F. Mott; John R. Manning; Paul F. McCaul

[57] ABSTRACT

A coal pump is provided in which solid coal is heated in the barrel of an extruder under pressure to a temperature at which the coal assumes plastic properties. The coal is continuously extruded, without static zones, using, for example, screw extrusion preferably without venting through a reduced diameter die to form a dispersed spray. As a result, the dispersed coal may be continuously injected into vessels or combustors at any pressure up to the maximum pressure developed in the extrusion device. The coal may be premixed with other materials such as desulfurization aids or reducible metal ores so that reactions occur, during or after conversion to its plastic state. Alternatively, the coal may be processed and caused to react after extrusion, through the die, with, for example, liquid oxidizers, whereby a coal reactor is provided. Alternative utilization of the device may be to secure continuous pyrolysis of the coal or to feed the extruded coal into furnaces operating at pressures near ambient.

17 Claims, 8 Drawing Figures

CONTINUOUS COAL PROCESSING METHOD

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435 USC 2457).

CROSS REFERENCE TO RELATED APPLICATION

This application is a continuation-in-part of Ser. No. 623,389 filed Oct. 17, 1975, now abandoned.

BACKGROUND OF THE INVENTION

1. Field of the Invention

The present invention relates to a coal feeding and/or processing system and, more particularly to a continuous coal extrusion apparatus and method.

2. Description of the Prior Art

The U.S. reserve of coal is about 3 trillion tons. Although coal represents the most abundant fossil fuel in the United States, and in other countries, current consumption patterns indicate that petroleum-derived fuels represent 80% of the total U.S. consumption, and coal less than 20% of the total. A principal reason for the failure to utilize this vast coal reserve has been the lack of an economical process for transferring coal in a form suitable for efficient conversion. Whereas, petroleum-derived raw materials are readily pumped and transferred at any desired process temperature and pressure for rapid conversion, it has not been possible to move and process massive quantities of coal in a regulated and reliable manner through conventional fuel processing reactors.

The lack of high flow rates, and lack of capability of adjusting total feed rates to match particular requirements of known conversion schemes has severely limited coal process development and means for transferring coal, or other carbonaceous material from the solid state at ambient pressures, directly into elevated temperature and pressure vessels for continuous conversion. An effective direct coal transfer apparatus and method has long been desired, permitting use of raw coal directly at any desired flow rate and at any pressure. Fusion of coal in the open air by application of heat is described in coal analysis publications, for example, a 1971 publication by the Bureau of Mines, by Wu et al, Bulletin 661, entitled "Coal Composition, Coal Plasticity and Coke Strength." When the temperature of a small mass of coal is raised slowly, gases and vapors evolve until the softening temperature of the particular coal is reached. Typically, coal does not fuse at well-defined temperatures, but for each type of coal there is a short temperature range within which enough liquid product is produced to cause the entire mass of coal or of coal particles to coalesce, fusing sufficiently to become plastic. This phenomenon has been used in coal processing apparatus and methods to a limited extent, but in every reported proposed application, has led to enormously troublesome operating difficulties and a commercially unacceptable process probably due to the fact that as coal is maintained at fusion temperature the viscosity at first drops and then increases until tar and solids are formed which deposit on the apparatus.

Prior art literature is replete with references to specific clogging and setting difficulties whenever raw coal is utilized as a feed, in an elevated and pressure system. For example, it is disclosed in U.S. Pat. No. 2,519,340 at Column 1, that when raw bituminous coal is directly passed into a thermal conversion process vessel, portions of the coal fuse into a high viscosity melted tarry mass. The presence of such tars in the described fuel bed gradually fills the voids and thus prevents requisite free flow of combustion air and steam. It is further disclosed that mechanical unclogging and stoking does not provide a solution of this clogging problem, which arises in nonpressured feed coal fusion systems.

More recently, it has been disclosed in the April 1976 paper of A. H. Furman entitled "Pressurized Feeding on the Gegas System" presented at the 81st AICHE Conference, Kansas City, Mo. that the direct heating and softening of coal at about 750° F. in an electrically heated, vented plastic extruder apparatus of a stated type provided tarry consistency solid products and gas evolution during softening regarded as so uncontrollable that further direct extrusion experiments were discontinued, and coal feeding was effected by mixing the coal with a binder-lubricant such as coal tar or asphalt and extruding the mixture at a low temperature of about 200° F. which is well below the softening point of coal.

Historically, there have been many systems for feeding coal. These have ranged from modifications of the primitive shovel to the large complex coal-feeding systems used in synthetic fuel plants. With the increasing interest in the production of synthetic gas and oil from coal, coupled with the economic advantages of large high-pressure gasifiers, the problem of reliably feeding coal continuously into pressure vessels at a high rate has become more acute. For several years, this has been recognized as a serious technical constraint in the commercialization of synthetic fuel plants.

There are several techniques for feeding coal into reactors that operate near ambient pressure but the choices narrow quickly as the pressure increases. Lock-hoppers have been used almost exclusively for pressures approaching 500 psi. Development work is under way to extend this range to approximately 1000 psi, even though at these pressures, the energy requirements for gas compression become large. Furthermore, lock-hoppers are limited to use with openings having maximum diameters of about 12–13 feet, do not handle fines too well, and it is difficult to reseal the hopper opening during and between loading cycles. Significant improvements in the lock-hopper techniques are needed to achieve the economic and reliability requirements of advanced processes currently under development. One variation of the lock-hopper method, a piston-feeder technique, is reported to significantly reduce the gas pressurization energy requirements while extending the pressure range to 1000 psi.

Above 1000 psi, the only commercially available technique is the slurry-pumping method where pulverized coal is mixed in approximately equal portions with water or a light oil and pumped by some form of positive displacement pump into the pressure vessel. This approach requires that the carrier liquid be separated from the coal at high pressure (except in liquefaction processes) thus placing added requirements for equipment and energy on the process. Other innovations have been advanced for feeding coal into pressures lower than 1000 psi, such as the paste-feed method, but these generally cannot be extended to higher pressure applications.

SUMMARY OF THE INVENTION

A high-rate continuous coal feeding and/or processing system and method have been developed in accordance with this invention. Diverse types of coal can be reliably processed by the system of the invention into a novel highly reactive form. The form of the processed coal can be varied from an atomized spray to an expanded porous ribbon or rod, depending on process parameters. Apparatus design and process parameters have also been determined.

The system of the invention proceeds by feeding coal to a hot cavity and heating the coal under compression to a temperature at which the viscosity is sufficiently low that the coal mass can be extruded with ease with low energy. The coal is continuously moved forward without static zones and is extruded through a reduced diameter die, usually directly into a reactor vessel in which it is reacted with oxidizing or hydrogenating agents.

The apparatus of the invention includes a coal extruder having a feed section and a compression section leading directly to a die orifice having a diameter smaller than the extruder barrel, means for compressing the coal within the barrel and means for heating the coal within the barrel which can include a heater for the barrel and for the compression member. The extruder can be a ram piston device but is preferably a screw-extruder since the auger action of the screw provides more controlled reliable continuous feed due to the more efficient mixing, better heat transfer rate and shear forces that are transferred to the mobile, fluid mass of compressed coal.

The parameters of the process have to be strictly controlled to provide the desired continuous flow of fluid coal product. Each feed coal has a temperature at which it exhibits plastic properties. In the present invention, softening is sufficient since mechanical forces from compression and shear aid in rendering the coal mass fluid. The temperature can be defined as that temperature at which the viscosity of the coal mass is less than $5\times10^3$ poise. This temperature is typically at least 325° C. However, excessively high temperatures should be avoided since the coal will quickly and irreversibly be transformed by polymerization or other processes to a solid that will deposit and interfere with the process. Temperatures at or above coking temperature, typically, 500° C. must be avoided. The preferred temperature is within 50° C. of the softening temperature.

Even when operating at or near the preferred softening temperature the irreversible coal solidification processes can occur at a slower rate and especially in areas or zones of higher heat or stagnation such as at the flight clearance or within the die. Therefore, the time interval between softening and extrusion from the die should be fairly short, usually below 15 minutes, typically from 3 to 10 minutes, depending on the coal feed, extruder pressure and extrusion rate.

The coal should be brought to near softening temperature by the time it reaches the compression section of the extruder. Therefore, the feed section should be heated, and with certain feeds it may be desirable to preheat the coal in the hopper before feeding it into the barrel of the extruder. Also, it may be desirable to heat the die in order to avoid deposition and clogging of the orifice, especially if the die has an elongated orifice.

The pressure within the compression section must be at least 500 psi. This assures adequate pressure for ejecting the fluid coal product from the die and maintains volatiles in a supercritical condition dissolved in the fluid mass of coal which is believed to increase fluidity. The prior coal extrusion processes at ambient or low pressure took measures to release these gases such as using a vented screw or pre-treated the coal to remove volatiles.

In the system of the invention the volatiles are maintained in the coal mass. The volatiles can be vented downstream of the delivery end of the apparatus. However, it is preferred to operate the apparatus in an unvented condition. In addition to increased fluidity, the volatiles are found to nucleate and devolatilize as bubbles through the mass of coal as it leaves the die causing atomization of the coal particles or void holes throughout the coal product forming a lighter, spongy, highly reactive product.

The form of the extrudate depends on pressure drop across the orifice. The pressure drop should be at least 500 psi in order to eject the material efficiently, especially as an atomized spray. If the pressure in the receiving vessel is below 800 psi the extrudate will self-atomize by devolatilization. If the pressure is above 800 psi in the receiving vessel, it will be necessary to add a fluid with a high critical pressure such as water to the coal mass in the barrel or high pressure region of the die. The critical pressure of water is 3200 psi. Therefore, if the pressure in the receiving vessel is 3200 psi or more it will be necessary to break up the extrudate by impingement techniques. The impinging stream may be a liquid oxidizer which will result in atomization, mixing and reaction within a short distance similar to liquid propulsion motors. Addition of water in correct proportion will cause continuous gasification of the coal.

Water soluble reactants such as catalysts or desulfurization aids may be added to the atomization water discussed above or to the coal feed. The coal feed may also contain small amounts of other additives such as surfactants, lubricants, dispersing aids, catalysts and the like or reducible reactants such as metal ore.

The coal feed is preferably finely sized so that it can be heated quickly to softening temperature. Also, the size of the coal should be such that it passes readily through the apparatus. Due to the possibility of the coal containing hard rock impurities the coal diameter should be smaller than ½ the minimum clearance between the screw and the barrel or the diameter of the die orifice. The coal is typically 10 mesh and may include fines. The coal may be of diverse origin and type. Hard coals having over 85% fixed carbon and low volatiles should be avoided since they are difficult to soften and extrude. Preferred coal feeds are bituminous and subbituminous coals having from 35–85% carbon, typically 65%–85% carbon, and at least 15% volatiles.

For coal pumping, the feed section may have constant pitch, and the compression section a variable pitch. Metering sections should be avoided since stagnation of fluid coal occurs, resulting in excessive local shear, heating and deposit of solid coal. Similarly, the die orifice is sized and designed to assure continuous forward movement of the fluid coal. The clearance between the screw flights and the barrel is sufficient to prevent backward flow of the fluid coal along the barrel but yet provides adequate clearance to prevent excessive wear. The clearance is usually from 1 to 3 mils, typically about 2 mils.

The form of extrudate is selected depending on the utilization device requirements. Self-atomizing sprays will find use as a coal pump for entrained flow or fluidized bed gassifier. The extruder can be readily operated at 5,000 to 15,000 psi or higher to provide a reliable continuous feed device to high pressure coal liquefaction, combustion or reaction devices.

Finally, powdered metallic ore may be intimately mixed with the coal, together with any necessary fluxing materials. The mixture may then be fed to a continuous extruder and heated. The plastic jet which is emitted is impinged on by a jet of an oxidizer (such as liquid oxygen) at high pressure. A reaction occurs and molten metal and slag fall to the bottom of the vessel into which the mixture has been fed. Liquid metal is withdrawn at the bottom of the vessel and slag may be withdrawn at an intermediate point.

These and many other features and attendant advantages of the invention will become apparent as the invention becomes better understood by reference to the following detailed description when considered in conjunction with the accompanying drawings.

DESCRIPTION OF THE EMBODIMENTS OF THE INVENTION

Figure 1:
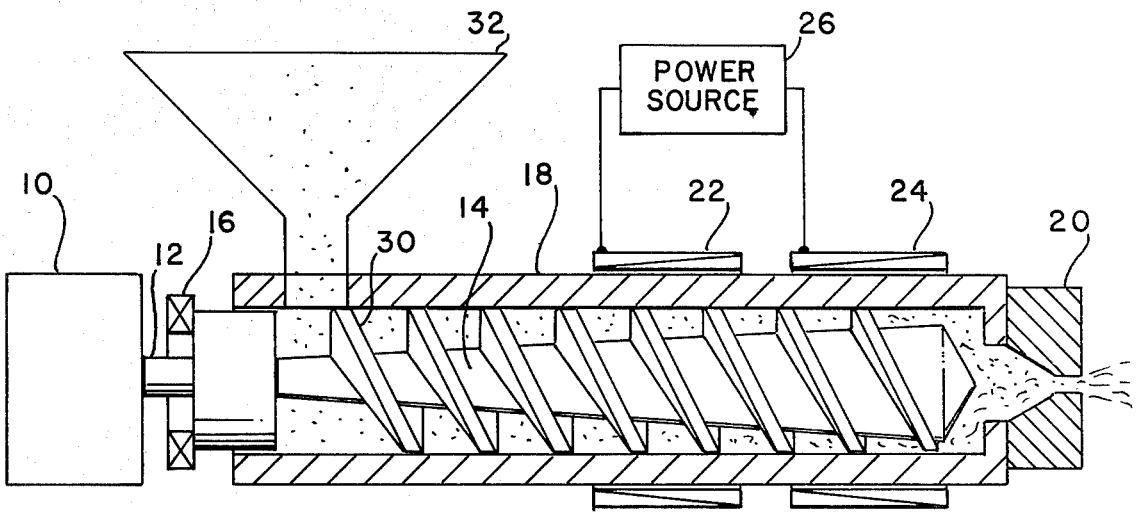
FIG. 1 is a cross-sectional and diagramatic view of an extruding apparatus, in accordance with this invention for permitting the continuous extrusion of coal.

FIG. 1 shows one method of continuous coal extrusion, which is preferred, in accordance with this invention. A drive motor 10 drives a shaft 12, which is coupled to a screw 14. The screw and drive shaft are supported in a well-known manner, by a bearing 16 so that the screw 14 can rotate in a barrel 18. The end of the barrel opposite to the one to which the shaft of the drive motor extends has an opening therein which is narrowed by a die 20, attached to the end of the barrel 18. Along the barrel there are spaced heaters, 22, 24, to which heating power is applied from a power source 26.

Coal is moved into the barrel 18, just ahead of the first flight 30 of the screw extruder by means of a coal hopper 32.

In operation, crushed coal, such as bituminous coal, is dropped into the hopper and is caught by the flight 30, as the screw 14 is rotated. The coal is crushed, advanced and pressure is applied by the rotating screw toward the die 20. The heaters 22, 24 bring the temperature of the coal between 390° C. to 490° C. at which temperature the coal is converted into its plastic state. As the screw extruder continues to rotate, the plastic coal is extruded from the opening of the die 20 in a continuous stream.

Figure 2:
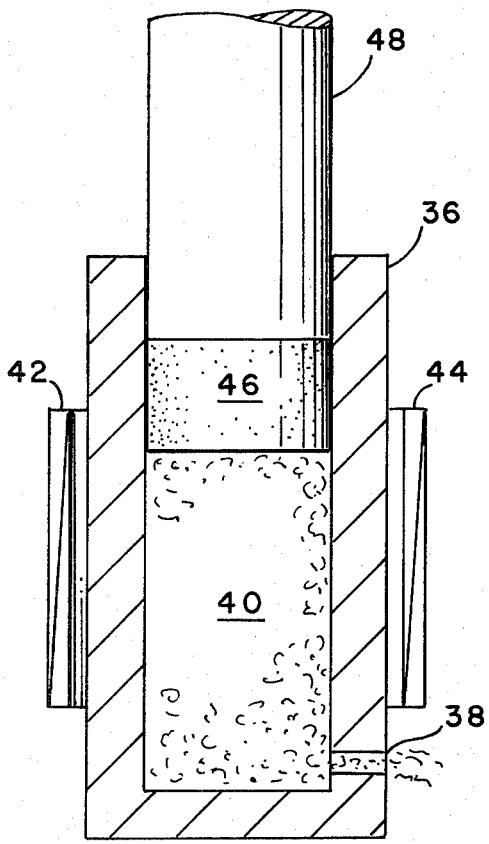
FIG. 2 illustrates in cross-section another extruding apparatus.

FIG. 2 shows an alternative arrangement for extruding plastic coal, which however, is not preferred. Here, a die 36 has an opening 38 therein which initially may be plugged, for example, by a suitable blow out plug or valve. The die cavity is filled with coal 40, which has been previously crushed. Electric heaters, respectively, 42, 44, heat the coal to its plastic state. Thereafter, a plug 46, which may be made of graphite, is pressed, by a piston 48, against the plastic coal. The temperature and pressure is raised high enough to cause blow out of the plug or valve opening to occur, and the plastic coal is emitted. This arrangement is not preferred, since it is not continuous. However in those applications where a continuous extrudate of plastic coal is not required, this arrangement may be used. Also for example, a number of these dies may be sequentially operated to provide a somewhat continuous supply of plastic coal.

Figure 3:
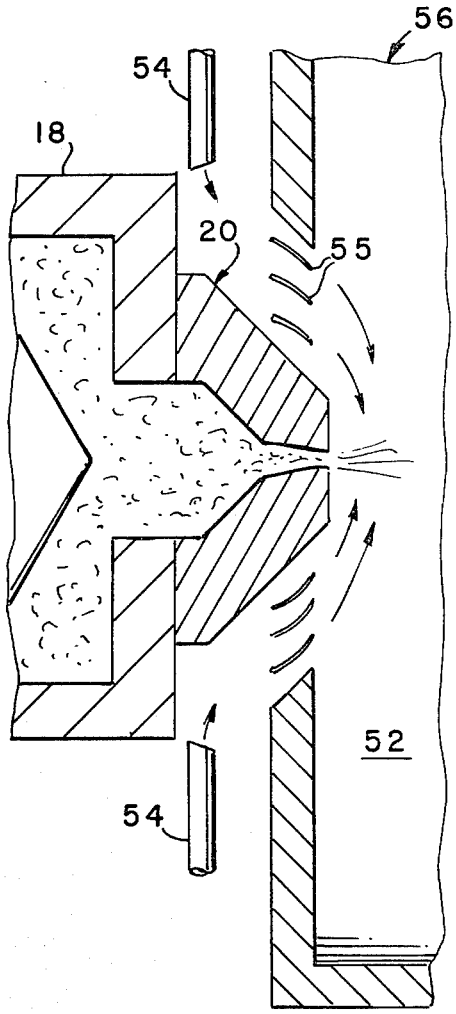
FIG. 3 illustrates schematically and in section, the invention being used to fire a furnace.

FIG. 3 shows a simple application for the continuous plastic coal feed in accordance with this invention comprising a simplified cross-sectional diagram for feeding the plastic coal into a furnace 50, which is operated at pressures near ambient. The output of the die 20 partially devolatilizes into char particles and gases and is introduced into the fire box 52 of the furnace. Air, from a source not shown, is introduced by means of a pipe 54 into the fire box 52, passing through swirl vanes 55, to be mixed with the jet of plastic coal being extruded.

Many coals, heated in the range of 390° C. to 490° C. become plastic. Within this range, many coals show a temperature region of maximum fluidity. For the practice of this invention, the region of maximum fluidity for a particular coal to be used should be determined in advance by well-known means and the temperature of the heaters at the barrel of the extruder should be established to provide this temperature range for the extruded plastic coal, to minimize the work required to extrude the feed and to assure the coal will be plastic. Extrusion occurs under these temperature conditions at pressures in the range of from 2000 to 12,000 psig. The coal extrudate, when forced through a die into a lower pressure region, partially devolatilizes in an abrupt fashion, as the higher boiling components flash off, thus disintegrating the jet into a spray of fine powder mixed with devolatilization products.

In its effect, this process achieves the desirable aim of introducing coal into a furnace in a finally divided and highly reactive form. While screw extrusion or extrusion by means of a piston may be employed, screw extrusion, which operates on a continuous basis, is preferred, in that all sizes of coal below a certain maximum size, preferably provide clearance between the minor screw diameter and the barrel and also less than the die orifice size may be used. For the piston arrangement, as shown in FIG. 2, herein, a similar requirement is desirable.

Although FIG. 3 illustrates the use of this invention to feed an atmospheric pressure boiler, it is not restricted to combustors operating at atmospheric pressure, and may be utilized to inject coal into furnaces and gasifiers operating at higher pressure. At reactor pressures in excess of about 400 psia, there will be an increasing tendency of the extrudate to form a coherent jet, and at reactor pressures in excess of 800 psia, a coherent jet will oridnarily be formed (if the particular coal used is moisture free).

Figure 5:
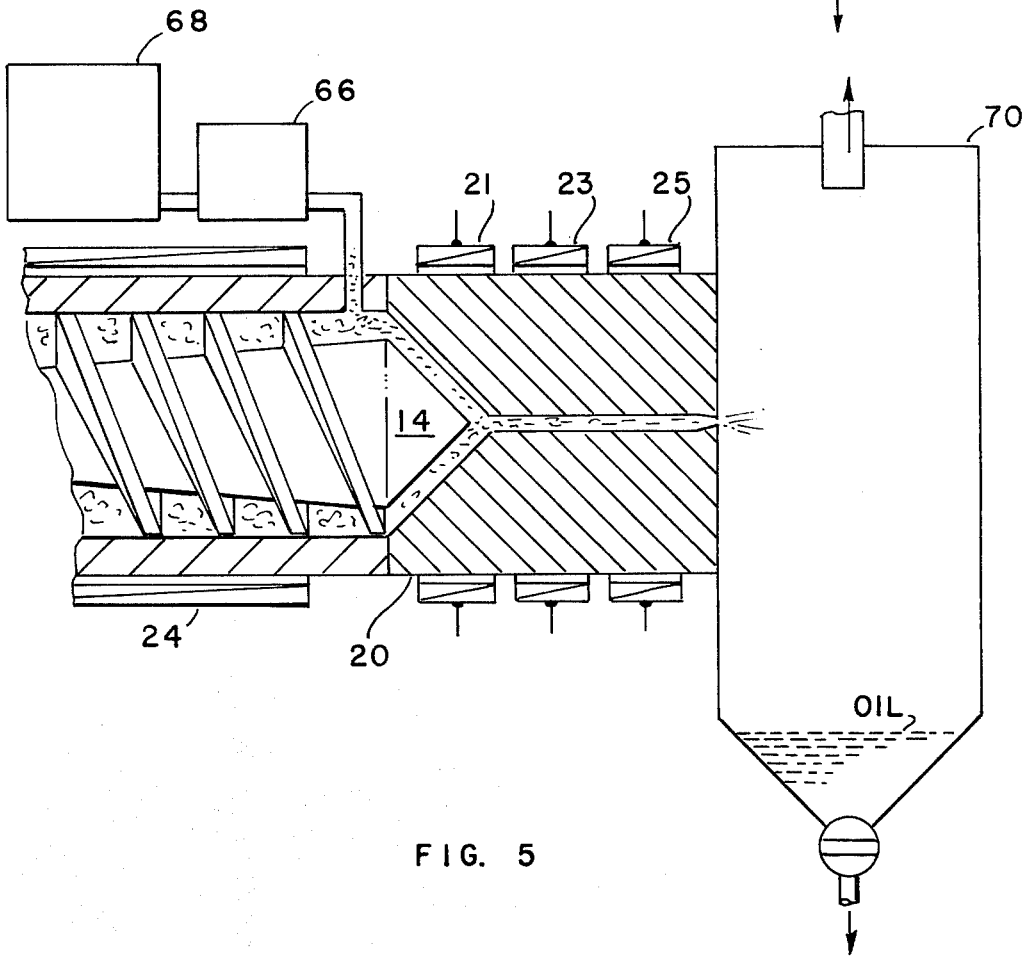
FIG. 5 illustrates schematically and in section, the invention being used for desulfurization and/or liquefaction.

Under these conditions, however, atomization of coal upon extrusion may still be achieved by injecting liquid water into the extruder as illustrated in FIG. 5, either at the end of the screw, or in the die. This technique is limited to reactor pressures below 3200 psia. Above this pressure atomization can be achieved by the impinging jet method, also described in this application. Thus, at reactor pressures below about 800 psia, this method of injecting coal will serve to provide a jet of atomized coal in a combustor or gasifier. If the reactor pressure is between 800 to 3200 psia, water may be comingled with the coal to assist in atomization upon injection. In reactors in which these pressure limits are exceeded, impingement techniques (jet on jet, or jet on solid body) may be used to atomize the coal.

Figure 4:
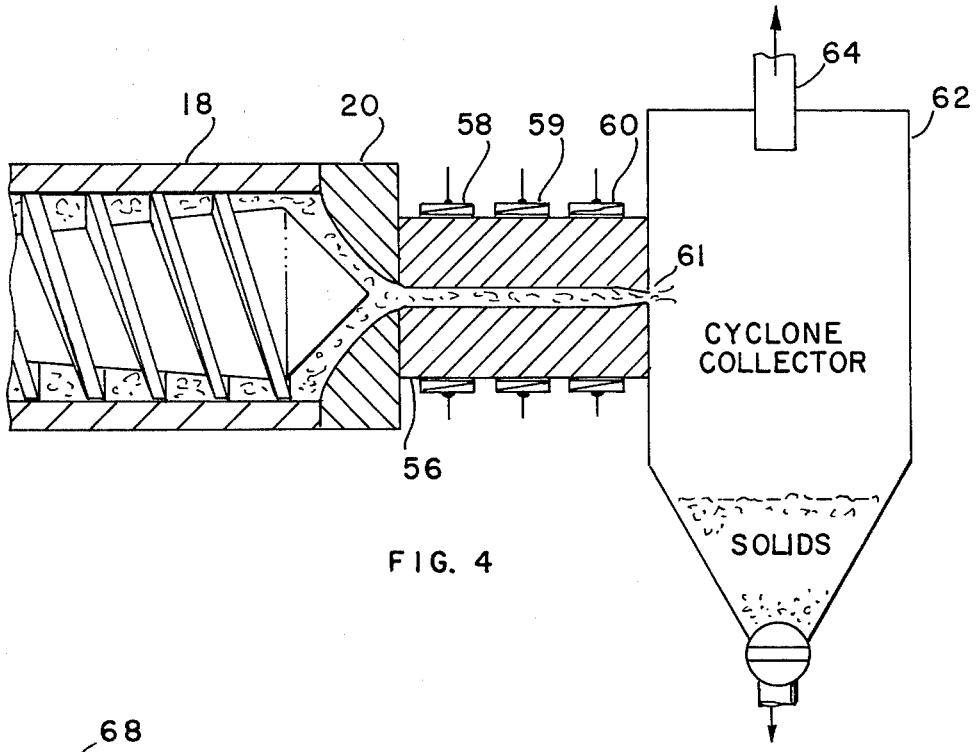
FIG. 4 illustrates schematically and in section, the invention being used for pyrolysis.

FIG. 4 is a cross-sectional and simplified view of apparatus for enabling the continuous pyrolysis of coal. The coal in its plastic state is extruded from the die 20 into a channel (e.g., a cylindrical hole), in a heavy block of metal 56, with the dimensions and strength of the metal chosen so as to safely confine the plastic coal at extrusion pressures. A temperature gradient is maintained along the length of this channel, employing heaters respectively 58, 59, 60, whereby the temperature may be increased from the temperature of the maximum fluidity of the particular coal (or other carbonaceous material, e.g. petroleum residuum at the entrance of the channel) to some higher value at the orifice which exits the channel. An important requirement is that the combination of temperature gradient and rate of movement of the coal be so regulated that only a minor amount of coking occurs prior to the orifice. If a major amount of coking is permitted to occur, flow will cease, as coke does not exhibit appreciable plasticity or fluidity in the temperature range of 390° C. to 490° C. and at the pressures of 2000 to 12,000 psig, employed in the extrusion of coal. For example, with a Utah bituminous coal (initial plastic temperature of 380° C.), with a temperature of 380° C. at the die (20) and 420° C. at the channel orifice (61) the residence time should not exceed 10 minutes (to avoid coking). With shorter residence times (less than one minute), still higher orifice temperatures (up to 700° to 800° C.) can be employed. Under these circumstances, however, the main die body should still be kept below 490° C. to avoid premature coking.

The heated plastic coal is extruded through the orifice 61 of the block 56 into a chamber 62, designated as a collector, which is a region of lower pressure (e.g. atmospheric pressure to 500 psig, depending on the process train down stream of the pyrolysis unit). The coal jet, containing components having higher vapor pressures than the receiver pressure, shatters as its high vapor pressure components flash off. A spray of finely divided char and the coal volatiles results. These may be separately collected by well-known means and further utilized. For example, the collector may in fact be a cyclone, or a multi stage cyclone. It will have an exhaust pipe 64, which carries off the coal volatiles. The spray of finely divided char which drops to the bottom of the collector can be removed by suitable means. The temperature of the coal at the exit orifice 61 will depend on the particular coal, but should not be less than 490° C., a commonly encountered coking temperature.

Regulation of the extrusion rate, the extrusion temperature, the extrusion temperature gradient, the die and orifice size and shape and the receiver temperature and pressure, are required to suit the properties of the particular coal, coal blend or other carbonaceous material being extruded. Thereby, any desired degree of devolatilization of the coal can be achieved. It is well known that rapid devolatilization enhances liquid yields, hence if high liquid yields are desired, the die and channel would be held at temperatures somewhat higher than that desired for the coal, and the coal flow rate would be adjusted to a residence time of 1 to 5 seconds. This process affords a highly reactive char and pyrolysis oil and gases.

FIG. 5 is a cross-sectional schematic view of an arrangement for desulfurization of coal in accordance with this invention. In the practice of this invention, dilute aqueous solutions of sodium or potassium acetate, formate, carbonate, bicarbonate halides or other salts (e.g., KCl, $K_2CO_3$, $KHCO_3$, $CHO_2K$ $CH_3CO_2K$, NaCl, $Na_2CO_3$,$NaHCO_3$, $CHO_2Na$, or $CH_3CO_2Na$) are injected by means of a pump 66, from a source 68 of catalyst solution, into the region of the screw extruder 14, which is just ahead of the last land of the screw or just ahead of the entrance to the die. Shear in this region, and in the die entrance is well-known to degrade high polymers by the breaking of chemical bonds. In the case of coal, petroleum residue, asphalt, or similar materials, in the presence of super-critical water, conditions in the extrusion region are regulated such that both the critical pressure 3200 psi and the critical temperature 374° C. of water are exceeded. This chemical action initiates reaction of coal molecules with water, leading to the addition of hydrogen to the coal molecules, the cleavage of bonds involving sulphur, formation of $H_2S$ and the liquefaction of the coal.

The reaction time which may vary from a few seconds to 15 minutes depending on the particular coal, for this process is regulated by the injection rate and the length of the extrusion channel, the degree of shear by the properties of the coal and the screw extruder, the temperature by any of several well-known means, and the pressure by the injection rates and the orifice dimensions. Extrusion conditions are arranged so that temperatures in excess of temperature of maximum fluidity of the coal is reached in the region of maximum shear e.g., and pressures in the range of 3500 to 12,000 psig are attained. To attain required temperatures and dwell time the die 20 may be lengthened and heaters 21, 23, 25 may be placed alongside the die in addition to the heaters 22, 24 on the barrel of the screw extruder.

Where petroleum residue is introduced into the screw extruder, the residuum is upgraded by sulphur removal and the addition of hydrogen. Oxygen in the water ultimately is converted to CO and $CO_2$, though it may pass through states of being incorporated into the organic material as alcohol groups, or carbonyl groups, or both.

The resultant product is extruded into a collector 70, wherein the $H_2S$ and whatever light hydro-carbon gases are collected, and the $H_2S$ removed by well-known means. The liquid product is removed from the bottom of the collector and then may be refined or otherwise utilized by well-known means.

Freshly mined coal may be converted to a liquid in this manner in the mine, transported to the surface and distributed as a liquid.

Figure 6:
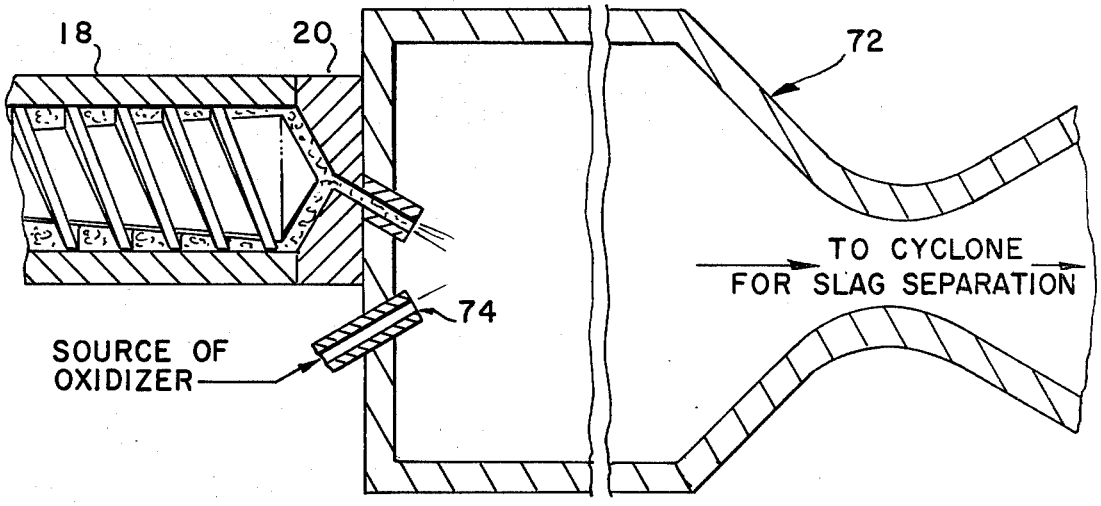
FIG. 6 illustrates schematically and in section, the invention used for a coal reactor.

FIG. 6 illustrates, a schematic and cross-sectional view of an embodiment of the invention used as a high intensity coal reactor. Coal in its plastic state is extruded into a relatively high pressure vessel 72, (2800 to 5000 psia) in the form of a coherent jet. This jet is caused to impinge upon a jet or jets of oxidizer which are fed through a nozzle 74, from a source not shown. The oxidizer may be liquid oxygen, liquid air, gaseous oxygen, gaseous air or liquid $N_2O_4$, or similar oxidizers well-known to the combustion art. As a result of the impingement, on the hot coal in the plastic state, of the jet of liquid oxygen, ignition occurs on contact, i.e., the combination is hypergolic. The pressure in the vessel is maintained by means well-known in the art of rocketry, i.e., pressure in the vessel is determined by the massive flow of reactants into the vessel, the thermochemistry of the reacting mixture and the area of the exit orifice (throat) of the reaction chamber.

The advantage of this method of impinging coal and oxidizer lies in the excellent mixing product produced by two jets when the dynamical properties of the jets are properly selected for optimum mixing according to well-known principles of liquid rocket injector design. In particular, the employment of a multiplicity of impinging jets of fuel (e.g. coal) and oxidizer (e.g. liquid $O_2$), in a manner well-known in liquid propellant art may be employed to construct reactors of any desired size. The effect of intimately mixing and efficiently atomizing the reactants is to enhance reaction whence the combustion process will be completed in a short time compared to the usual methods of firing coal and other viscous carbonaceous materials. Much smaller equipment, operating at higher pressures than now commercially possible, can be obtained by application of this method.

Both combustors and gasifiers may employ this technique. For the case of gasifiers, water must be added to the coal or other carbonaceous fuel and the stoichiometry of the reactants adjusted to favor $H_2$ and CO formation according to the art of coal gasification. Water may be added, either as an additional fluid jet at the impingement point, or injected into the extrusion die, in the manner shown in FIG. 5, at the entrance into the extrusion orifice. Either synthesis gas or low BTU gas can be produced in gasifiers which employ this invention, which depend on the use of pure $O_2$ or air respectively in the gasification reaction.

Figure 7:
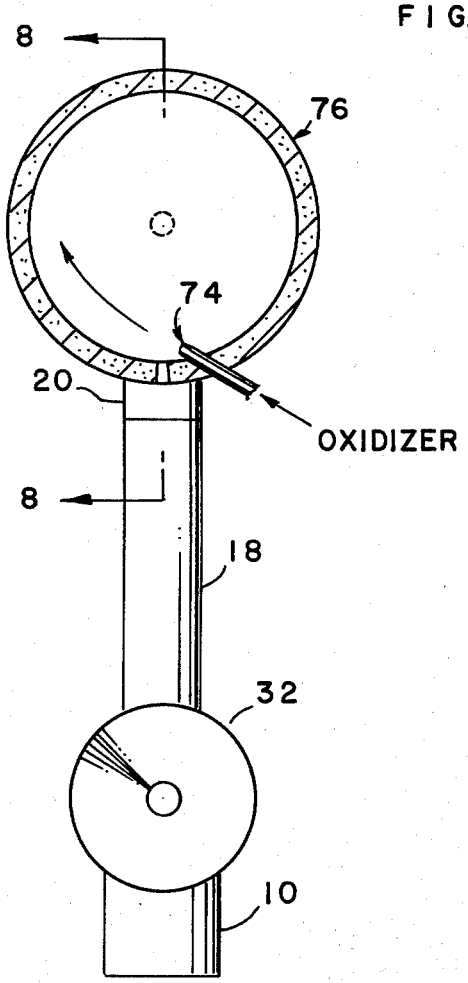
FIG. 7 and FIG. 8 are respectively schematic views in plan and elevation of the invention being used for ore reduction.
Figure 8:
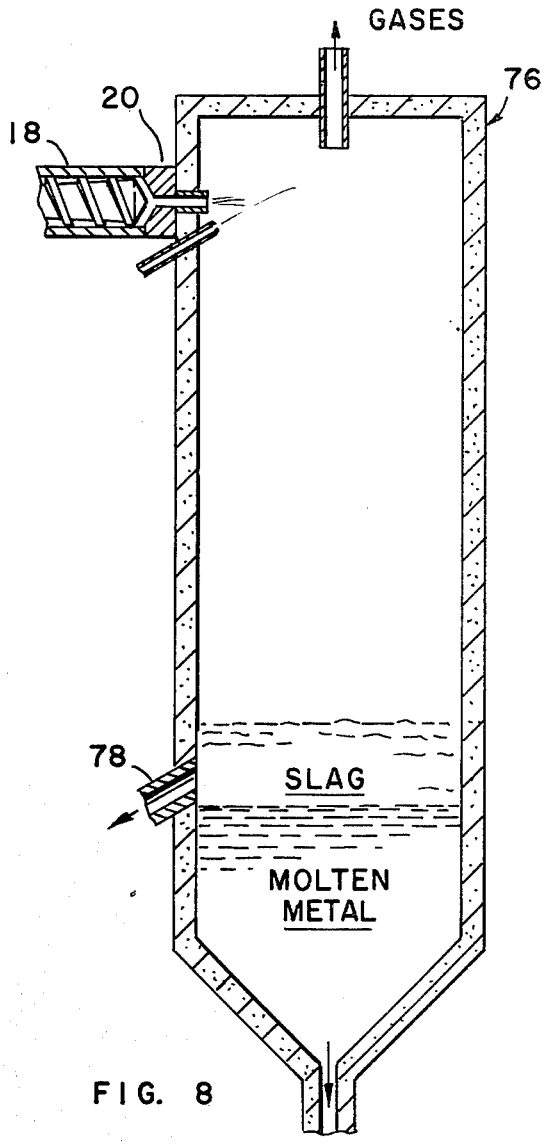

Another useful purpose to which this invention may be put is schematically illustrated in FIGS. 7 and 8. This is for enabling the continuous reduction of ores. FIG. 7 is a plan view in section and FIG. 8 is a view in elevation. Instead of only coal being introduced into the hopper 32, as described in connection with FIG. 1, powdered metallic ore is intimately mixed with coal and necessary fluxing materials, and the mixture fed through the hopper into the continuous extruder and heated in the manner described. The jet of an admixture, so produced, is impinged on a jet of an oxidizer (liquid oxygen) coming through an orifice 74, from a source not shown, into a chamber 76. Chamber 76 is lined with refractory material in a manner well known to the art. FIG. 7 shows only one injection doublet arranged so that the resultant momentum vector at the jet impingement point is tangential to the vessel. Obviously, a multiplicity of such injectors both radially and axially distributed on vessel 76 may be employed. A reaction occurs, and molten metal and slag fall towards the bottom of the vessel. A tap 78 between the bottom of the vessel and the region of the reaction, is utilized to draw off the slag. The liquid metal may be tapped or periodically withdrawn from the bottom of the vessel in manner well-known.

The jet impingement reactor schematically represented in FIGS. 7 and 8 is a device well-known in the art of liquid propellant rocketry, as is the technique for optimum mixing and atomization in impinging jets. These may be employed with this embodiment of the invention to attain a maximum reaction rate.

EXAMPLES OF PRACTICE FOLLOW

EXAMPLE 1

The feasibility of extruding coal was determined in a small piston die extruder similar to the device shown in FIG. 2. The cylindrical chamber had a 0.300 inch diameter with a 30° conical bottom having a 0.050 inch diameter orifice which was plugged by swageing with a small piece of zinc metal. The chamber, piston and die were heated to 377° C. with a band heater. Utah bituminous was added, a graphite plug inserted, and the piston reinserted. Ram force was maintained between 1000 and 2000 pounds force (5000–10,000 psi) while the die was heated to a higher temperature by increasing voltage to the band heater. At about 400°–420° C., the zinc plug melted or was extruded and the plastic coal extruded into the atmosphere giving rise to a spray of powdered (partially devolatilized) coal issuing from the die orifice.

When the experiment was repeated without application of heat, the coal did not extrude. It was completely unexpected and quite surprising that the volatiles contained in the plastic coal would be able to provide a disrupted, atomized coal particle spray. A continuous cylindrical plastic coal extrudate was expected.

EXAMPLE 2

A further experiment was conducted in a ram piston device having a 0.02 inch side orifice as shown in FIG. 2, and a one inch diameter chamber. When Utah bituminous coal was heated to 390° C. and pressurized to 5000 psig, a devolatilizing spray of fine coal particles was expelled from the orifice in the side of the die. Evidently, volatiles which were formed during heating of the coal were compressed into nucleated bubbles and flash vaporized as the plastic stream was extruded from the die at high pressure into the atmosphere. Vapor nucleation and bubble growth occurred at a sufficiently rapid rate to atomize the coal.

Preliminary data on the rheological properties of coal have been obtained in a JPL-fabricated capillary rheometer. Short L/D capillaries have been used, therefore, substantial corrections to computed shear stresses have been required. These data indicate that the fluidity of the Utah coal decreases markedly with heating time; coal heated 20 to 30 minutes prior to extrusion is extremely viscous (shear rate of approximately 0.4 $sec^{-1}$ for shear stress of 320 psia). This is order of magnitude more viscous than the usual thermoplastic. Qualitative results, on a modified version of the rheometer, suggest much higher shear rates at lower shear stresses with shorter (5 to 10 minute) heating times. These results are in qualitative accord with the observed power consumption of the extruder with comparable coal residence times.

Empirical studies of extrusion temperatures were made using capillary rheometry by extruding plastic coal through a small L/D capillary of known dimension at a fixed pressure and fixed heating rate. Estimated extrusion temperatures are shown in the following table.

TABLE 1

| Coal | Estimated °C. | Extrusion Temperature °F. |
|---|---|---|
| Utah | 415 | 880 |
| Elkhorn-Hazard | 413–418 | 775–784 |
| Kentucky No.9 | 398 | 748 |

TABLE 1 -continued

| Coal | Estimated °C. | Extrusion Temperature °F. |
|---|---|---|
| Milburn No. 4 | 393 | 739 |

Screw extrusion of plastic coal was then attempted in a conventional thermoplastic extruder utilizing a conventional 31 inch polyethylene screw having a terminal 10½ inch metering section (Example 6) and 33 inch screws having no metering section and gradual compression (Examples 3, 4, 5). Compression ratio (C.R.) is the ratio of annular areas of the feed to compression sections defined as $$C.R. = \frac{\text{Area of annulus between barrel and screw root at feed section}}{\text{Area of annulus between barrel and screw root at point of maximum screw root diameter}}$$

The extruder (Centerline Machinery Co., Santa Ana, Calif.) had a 1½ inch I.D. barrel having a high alloy steel, Xaloy 101 liner in a 3.5 inch O.D. 4140 steel barrel. The die orifice was 3/16 inches with 40° taper. The barrel and die were clamped together with two hydraulically actuated clamps.

Analytical data for the coals utilized and one extrudate are presented in Table 2.

TABLE 2

| Analysis | Utah | Elkhorn Hazard (Ky.) | Ky. #9 (Ky.) | Milburn #4 (W.Va.) | Milburn #4 Extrudate (W.Va.)* |
|---|---|---|---|---|---|
| Proximate Analysis (As Received) | | | | | |
| Moisture, Wt % | 2.65 | 2.90 | 3.58 | 3.46 | 2.90 |
| Ash, wt % | 5.82 | 4.10 | 8.93 | 10.18 | 8.86 |
| Volatile, Wt % | 45.88 | 38.59 | 40.36 | 32.20 | 31.30 |
| Fixed Carbon, Wt % | 45.65 | 54.41 | 47.13 | 54.16 | 56.94 |
| Heating Value, BTU | 13220 | 13877 | 12783 | 13233 | 13587 |
| Sulfur, Wt % | 0.74 | 0.96 | 3.22 | 2.59 | 2.25 |
| Ultimate Analysis (As Received) | | | | | |
| Hydrogen, Wt % | 6.41 | 5.75 | 5.74 | 5.25 | 5.29 |
| Carbon, Wt % | 73.22 | 76.37 | 69.64 | 77.56 | 73.54 |
| Nitrogen, Wt % | 1.48 | 1.67 | 1.52 | 1.19 | 1.27 |
| Oxygen, Wt % | 12.33 | 11.15 | 10.95 | 3.23 | 8.79 |
| Coal Plasticity (Giesler Plastometer) | | | | | |
| Maximum Fluidity (D.D.P.M.) | 5.3 | 615 | 795 | 28,000+ | 1845 |
| Temp. at Max. Fluidity | 429° C. | 441° C. | 426° C. | 432°-456° C. | 447° C. |
| Temp. at Start (1D.D.P.M.) | 407° C. | 404° C. | 386° C. | 377° C. | 352° C. |
| Temp at Final (1D.D.P.M.) | 441° C. | 466° C. | 461° C. | 488° C. | 485° C. |
| Temperature Range | 34° C. | 62° C. | 75° C. | 111° C. | 133° C. |
| Free Swelling Index | 2.0 | 6.0 | 5.5 | 8.5 | 8.0 |

*Cooled in Air

All coals included fines and were air dried except for Example 5 in which the Kentucky No. 9 coal was predried in air at 250° F. The clamping pressure was 4,000 to 5,000 psi and the downstream die pressure was atmospheric. The other variables are presented in Table 3.

TABLE 3

| | Milburn #4 (W.Va.) | Elkhorn-Hazard Mixture (Ky) | Kentucky #9 (Ky) | Utah (Mine Unknown) |
|---|---|---|---|---|
| Screw C.R. | 3.2 | 3.2 | 2.6 | 3.2 |
| Coal Size | −10 mesh | 010 mesh | −10 mesh | −20 mesh |
| Feed Rate | 14.3 lbs./hr | 14.3 lbs./hr | 10 lbs./hr | 300 cc total |
| Screw Speed, rpm | 58 | 120 | 120 | 32 |
| Temperatures (°F.) | | | | |
| Feed T (preheated) | 300° F. | 300° F. | 500° F. | 60° F. |
| Feed Zone | 650 | 750 | 650 | 430 |
| Initial Compression Zone | 790 | 800 | 800 | 640 |
| Final Compression Zone | 790 | 800 | 800 | 730 |
| Die | 790 | 800 | 800 | 720 |
| Output lbs/kw hr | 17.4 | 8.9 | (~50) | |

The Utah coal of Example 6 was extruded as an atomized spray. However, solids deposited due to the excessive shear and residence of the plastic coal in the metering section and a small amount of coal (300 cc), less than 1 pound was intermittently extruded over a period of 15–20 minutes. The temperature appeared to be too low. The extrudates of Examples 3, 4, 5 were continuously and reliably extruded as a porous, sponge appearing rod. Using a smaller die orifice and higher pressure in the compression section, a fine atomized spray results on devolatilization of the extrudate.

It is to be realized that only preferred embodiments of the invention have been described and that numerous modifications, alterations and substitutions are all permissible without departing from the spirit and scope of the invention as defined in the following claims.

What is claimed is:

1. A method of processing particulate coal comprising the steps of:

Compressing said coal at high pressure in the barrel of an extruder while heating it to a temperature at which the coal mass can be extruded with low energy;

adding a liquid having a high critical pressure to the coal before extruding the coal through a die; and continuously extruding said heated, compressed coal and liquid through a die having a diameter smaller than the barrel diameter.

2. A method according to claim 1 in which the liquid is water.

3. A method according to claim 2 in which the water has a water soluble reagent dissolved therein.

4. A method according to claim 3 in which the reagent is a coal desulfurization agent.

5. A method of processing particulate coal comprising the steps of:

adding to said coal a material reducible under the conditions of extrusion;

compressing said coal at high pressure in the barrel of an extruder while heating it to a temperature at which the coal mass can be extruded with low energy; and continuously extruding said heated, compressed coal through a die having a diameter smaller than the barrel diameter.

6. A method according to claim 5 in which the material is a metal ore and fluxing agent.

7. A method of processing particulate coal containing at least 15% by weight of volatiles comprising the steps of:

compressing said coal at a pressure of at least 500 psi in the unvented barrel of an extruder while heating it to a temperature from 325 degrees C. to 500 degrees C. to form a mobile fluid mass containing compressed nucleated bubbles of said volatiles which can be extruded with low energy;

continuously extruding said heated, compressed, mobile mass of coal through said barrel without stagnation zones and without venting and through a die having a diameter no more than ¼ the diameter of the barrel and;

releasing said compressed bubbles of volatiles on ejection from the die to form a porous coal extrudate.

8. A method according to claim 7 in which the extruder includes a screw for continuously moving the coal through the barrel and die.

9. A method according to claim 7 in which the pressure is from 8,000 to 15,000 psi.

10. A method according to claim 7 in which the temperature is the temperature at which the coal has a viscosity less than 5,000 poise.

11. A method according to claim 10 in which the coal is heated to at least said temperature within the compression section of the barrel and in the die.

12. A method according to claim 7 in which the released volatiles form an atomized spray of coal particles.

13. A method according to claim 7 in which the coal extrudate forms an atomized spray of coal particles and further including the step of moving said particles with air and igniting said mixture.

14. A method of processing particulate coal comprising the steps of:

compressing said coal at high pressure in the barrel of an extruder while heating it to a temperature at which the coal mass can be extruded with low energy;

adding water to the coal before ejecting it through an extrusion die;

continuously extruding said heated, compressed coal through a die having a diameter smaller than the barrel diameter as a spray of coal particles directly into a high pressure reaction vessel in which the pressure drop across the die into the vessel is at least 500 psi and the pressure within the reaction vessel is between 800 psi and 3,200 psi.

15. A method according to claim 14 in which the reaction vessel is a coal gasification reactor.

16. A method according to claim 14 in which the pressure in the vessel is above 3200 psi and further including the step of fragmenting the extrudate into coal particles by impingment.

17. A method according to claim 14 in which the extrudate is fragmented by impingement with a stream of liquid oxidizer.

* * * * *